US007066115B2

(12) United States Patent
Arseneau

(10) Patent No.: US 7,066,115 B2
(45) Date of Patent: Jun. 27, 2006

(54) INTERNAL COMBUSTION ENGINE/HYDRAULIC MOTOR/FLUID PUMP PROVIDED WITH OPPOSITE PISTONS

(75) Inventor: Michel Arseneau, Beauharnois (CA)

(73) Assignee: 9121-6168 Quebec Inc., Montreal (CA)

( * ) Notice: Subject to any disclaimer, the term of this patent is extended or adjusted under 35 U.S.C. 154(b) by 0 days.

(21) Appl. No.: 10/615,373

(22) Filed: Jul. 9, 2003

(65) Prior Publication Data

US 2004/0050348 A1 Mar. 18, 2004

Related U.S. Application Data

(60) Provisional application No. 60/410,819, filed on Sep. 16, 2002.

(51) Int. Cl.
*F02F 3/24* (2006.01)

(52) U.S. Cl. ..... 123/44 B; 123/44 E; 123/307; 123/193.4; 123/196.4

(58) Field of Classification Search ..... 123/44 B, 123/44 E, 51 B, 301, 657, 44 D, 671, 307, 123/666, 193.4, 193.6; 277/371; 92/58, 92/72; 91/491, 499
See application file for complete search history.

(56) References Cited

U.S. PATENT DOCUMENTS 592,073 A * 10/1897 Auriol ..... 123/44 B
1,309,554 A 7/1919 Tiberti
1,901,448 A * 3/1933 High ..... 123/307
2,181,705 A * 11/1939 Meyer ..... 123/44 D
2,688,320 A 9/1954 Czarnocki ..... 123/193.4
2,735,416 A 2/1956 Ferguson et al. ..... 123/193.4
2,894,496 A * 7/1959 Townsend ..... 123/44 E
2,989,005 A * 6/1961 Gardineer, Jr. ..... 123/44 E
3,522,796 A * 8/1970 Mercer, Jr. ..... 123/44 E
3,601,008 A * 8/1971 Alexander ..... 123/193.6
3,604,406 A * 9/1971 Hottelet ..... 123/44 E
3,688,751 A * 9/1972 Sahagian ..... 123/44 B
3,766,900 A * 10/1973 Aiti ..... 123/657
4,030,471 A 6/1977 Ginkel ..... 123/44 B
4,112,881 A 9/1978 Townsend ..... 123/44 D
4,271,803 A * 6/1981 Nakanishi et al. ..... 123/193.4
4,334,506 A 6/1982 Albert ..... 123/44 E
4,377,136 A 3/1983 Evans
4,554,894 A 11/1985 Johnson (Continued)

FOREIGN PATENT DOCUMENTS

CA 1082603 7/1980 ..... 123/44 E (Continued)

*Primary Examiner*—Thai-Ba Trieu
(74) *Attorney, Agent, or Firm*—Hoffman Wassoon & Gitler

(57) ABSTRACT

An internal combustion engine has a pair of opposed pistons held within an elliptical guide of the engine housing. The pistons reciprocate within a cylinder attached to a shaft. A combustion chamber is formed within the shaft and positioned to be between the pistons. Combustion of fuel causes the pistons to reciprocate and reciprocation of the piston causes rotation of the shaft. A valve having an intake and out take port provide fuel and exhaust to the combustion chamber. A bridge extending upwardly form the bottom of the combustion chamber prevents fuel intake from exiting the exhaust before combustion.

15 Claims, 18 Drawing Sheets

U.S. PATENT DOCUMENTS

| | | | | | |
|---|---|---|---|---|---|
| 4,986,226 | A | * | 1/1991 | Lacy | 123/51 B |
| 5,344,164 | A | * | 9/1994 | Carmody et al. | 277/371 |
| 5,357,911 | A | | 10/1994 | Lindblad | 123/44 E |
| 5,375,564 | A | * | 12/1994 | Gail | 123/44 D |
| 5,390,634 | A | * | 2/1995 | Walters et al. | 123/671 |
| 5,671,702 | A | | 9/1997 | Lindblad | 123/44 E |
| 5,878,712 | A | * | 3/1999 | Wolters et al. | 123/301 |
| 5,967,102 | A | | 10/1999 | Huang | 123/44 D |
| 6,119,639 | A | | 9/2000 | Leijonberg | 123/44 E |
| 6,142,111 | A | | 11/2000 | Leijonberg | |
| 6,161,508 | A | | 12/2000 | Lindblad | 123/44 B |
| 6,250,263 | B1 | | 6/2001 | Sisco | |

FOREIGN PATENT DOCUMENTS

| | | | | | |
|---|---|---|---|---|---|
| DD | 145122 | A | * | 11/1980 | |
| DE | 2536739 | A | * | 3/1977 | |
| FR | 798881 | | * | 5/1936 | 123/44 B |
| GB | 2020739 | A | * | 11/1979 | 123/44 E |
| JP | 07224836 | A | * | 8/1995 | |
| WO | WO 9106752 | A1 | * | 5/1991 | 123/44 B |

* cited by examiner

INTERNAL COMBUSTION ENGINE/HYDRAULIC MOTOR/FLUID PUMP PROVIDED WITH OPPOSITE PISTONS

This application claims benefit of provisional application No. 60/410,819, filed Sep. 16, 2002.

FIELD OF THE INVENTION

The present invention relates to internal combustion engines hydraulic motors and fluid pumps. More specifically, the present invention is concerned with internal combustion engines, hydraulic motors and fluid pumps provided with two opposite pistons mounted in a rotating cylinder.

BACKGROUND OF THE INVENTION

Internal combustion engines are well known in the art. They are usually provided with at least one piston having a reciprocating movement that is transformed into a rotating movement via a mechanical assembly.

A major drawback with this conventional mechanical arrangement is that it is relatively complex and contains many elements, making it expensive and prone to failure. An example of such an arrangement is a conventional crankshaft.

An object of the present invention is therefore to provide an internal combustion engine provided with facing pistons mounted in a rotating cylinder.

Other objects, advantages and features of the present invention will become more apparent upon reading of the following non-restrictive description of preferred embodiments thereof, given by way of example only with reference to the accompanying drawings.

SUMMARY OF THE INVENTION

An internal combustion engine has a pair of opposed pistons held within an elliptical guide of the engine housing. The pistons reciprocate within a cylinder attached to a shaft. A combustion chamber is formed within the shaft and positioned to be between the pistons. Combustion of fuel causes the pistons to reciprocate and reciprocation of the piston causes rotation of the shaft. A valve having an intake and out take port provide fuel and exhaust to the combustion chamber. A bridge extending upwardly form the bottom of the combustion chamber prevents fuel intake from exiting the exhaust before combustion.

BRIEF DESCRIPTION OF THE DRAWINGS

In the appended drawings:

FIG. 2 is a sectional view taken along line 2—2 of FIG. 1F;

DESCRIPTION OF THE EMBODIMENT

Referring to FIGS. 1A to 8, a first aspect of the present invention, concerned with internal combustion engines will now be described.

Generally stated, a first aspect of the present invention proposes an internal combustion engine provided with two reciprocating pistons mounted in a single rotating cylinder. The pistons are so associated with an ellipsoid guide that their reciprocating movement forces the cylinder to rotate. A shaft is mounted to the cylinder to thereby be brought in rotation.

Figure 1A:
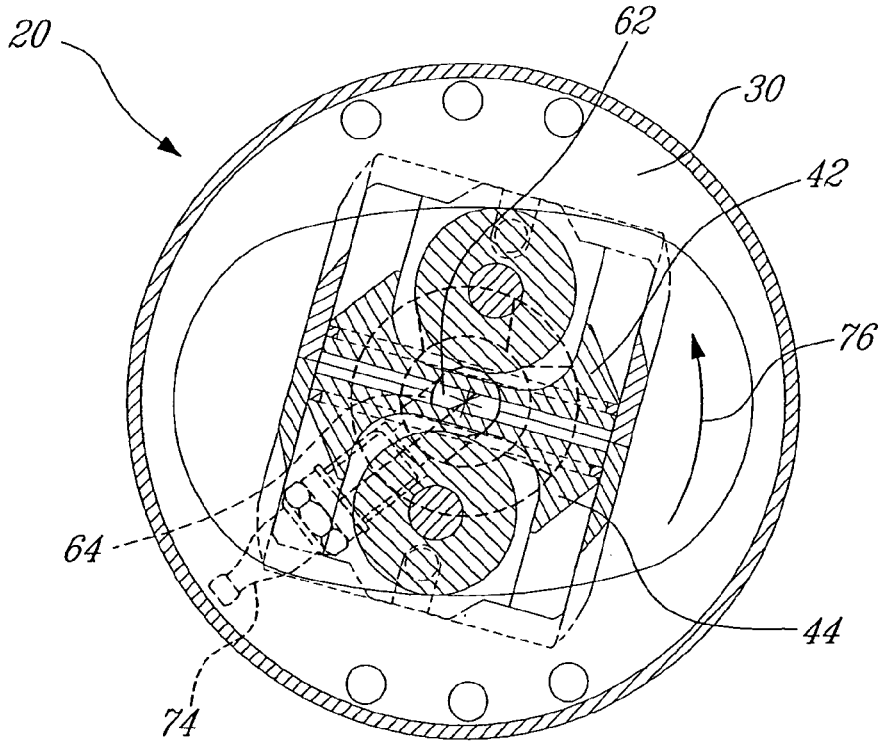
FIGS. 1A to 1K illustrate a sequence of operation of a four-cycle internal combustion engine according to an embodiment of the present invention.
Figure 1B:
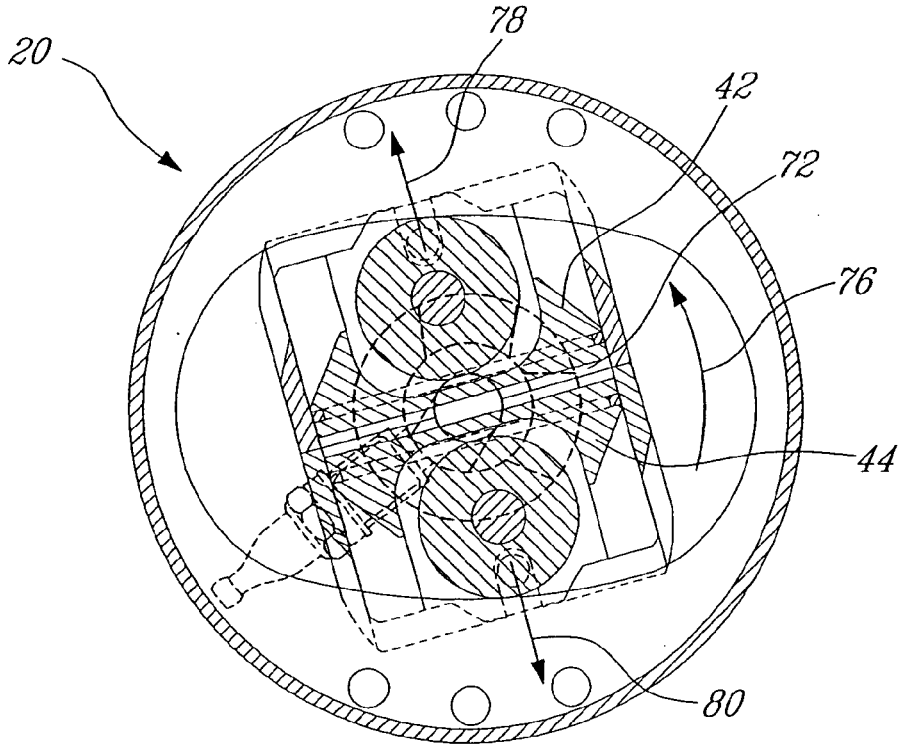
Figure 1C:
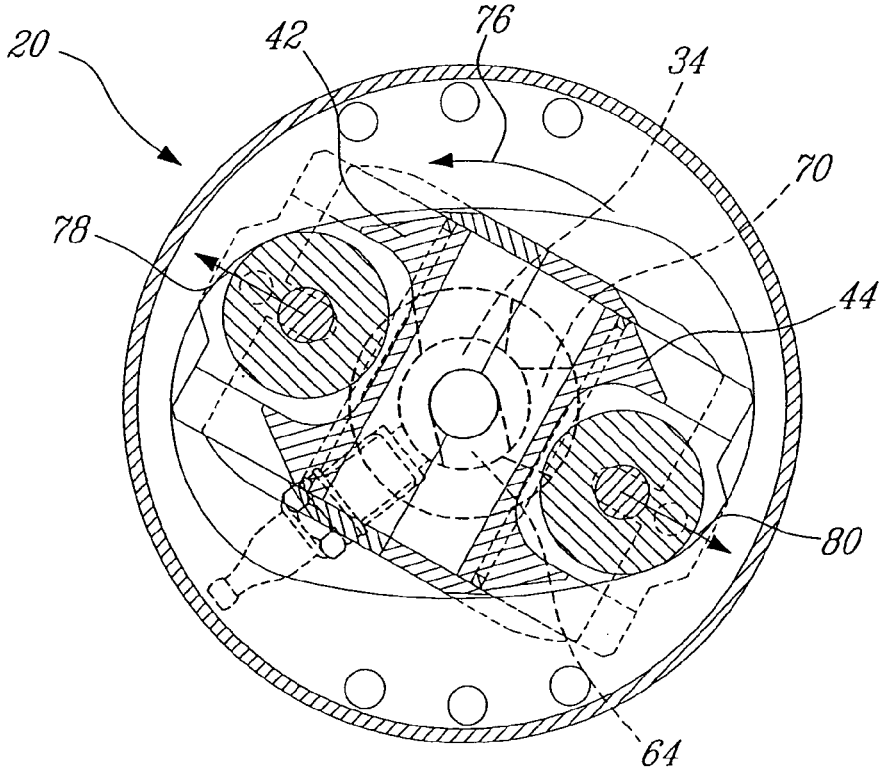
Figure 1D:
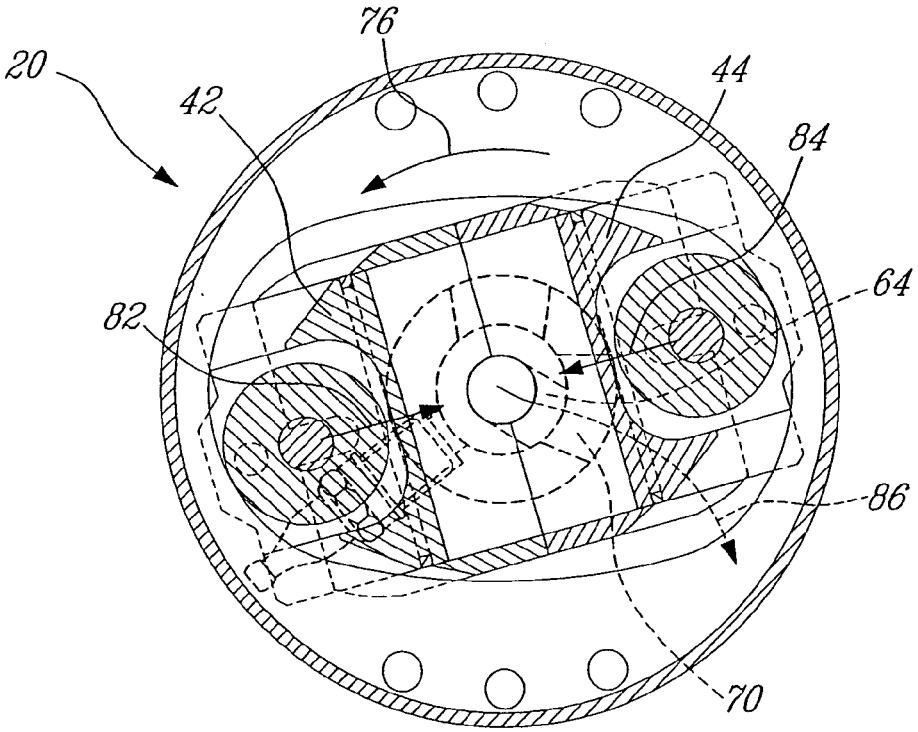
Figure 1E:
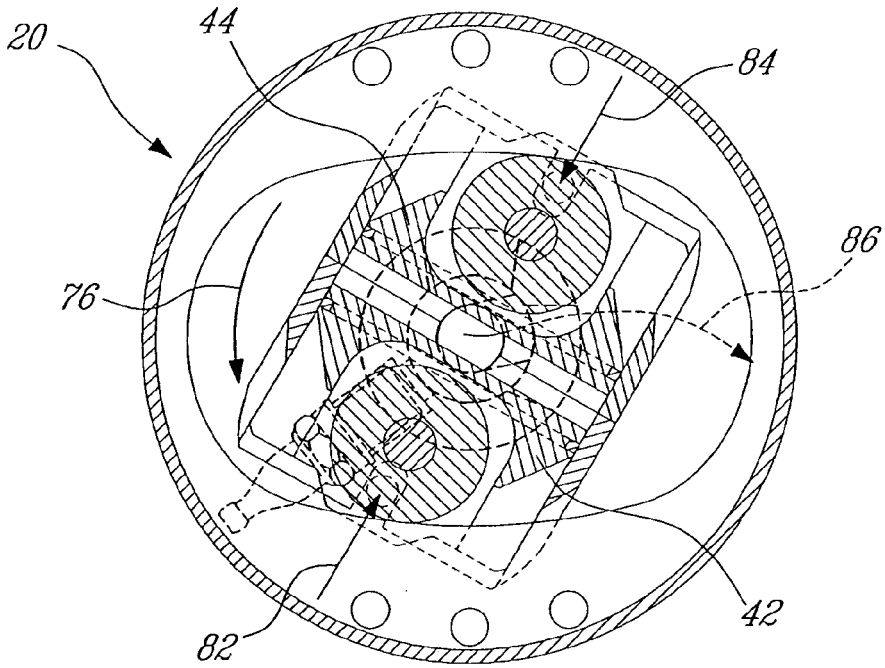
Figure 1F:
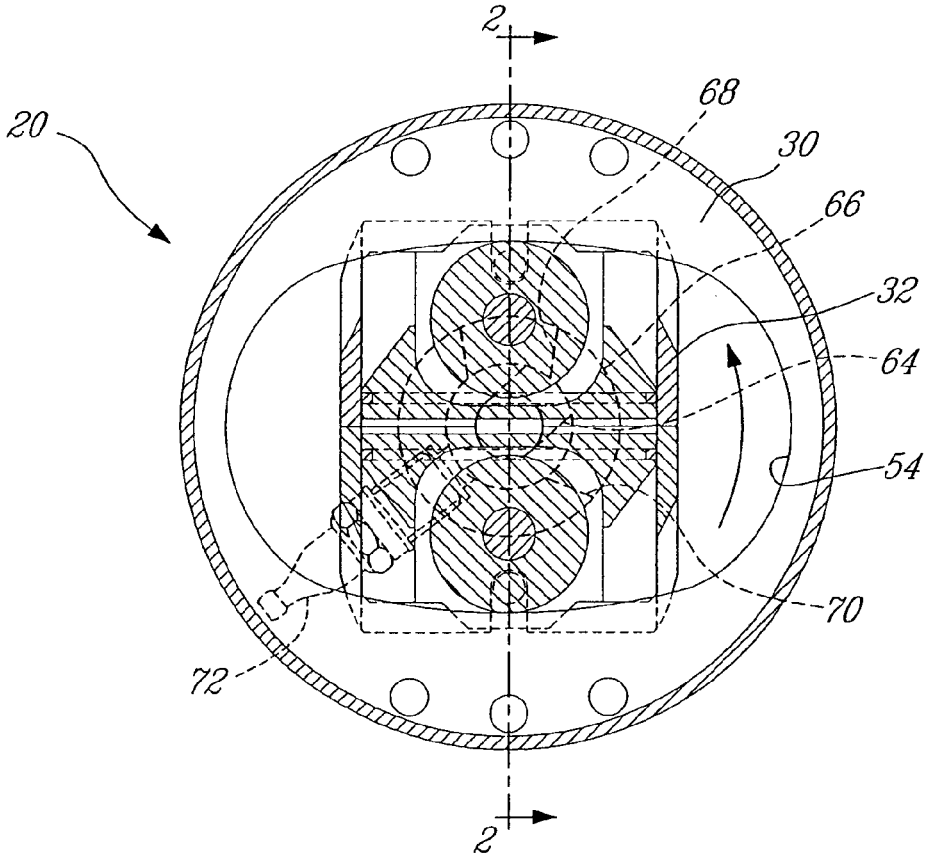

Referring now to FIGS. 1F and 2, an internal combustion engine 20 includes a body 22 having a first portion 24 and a second portion 26 secured via fasteners 28. The second portion 26 is provided with a mounting flange 27. The two body portions 24 and 26 sandwich an ellipsoid guide 30.

A cylinder 32, made of two identical halves, is mounted in the guide 30. One side of the cylinder is connected to a shaft 34 rotatably mounted to the first portion 24 of the body via two bearing assemblies 36, while the other side of the cylinder 32 has a projecting piece 38 rotatably mounted to the second portion 26 of the body via a bearing assembly 40. A fan element 35 is fixedly mounted to the shaft 34 to force air onto the body 22 to thereby cool it. Of course, other cooling mechanisms (not shown) could be provided. One skilled in the art will appreciate that the cylinder 32 could be made differently, for example by a casting process. Similarly, the cylinder 32 could be made of only one piece, including the shaft extensions.

Two reciprocating pistons 42 and 44 are so mounted in the cylinder 32 as to face each other. It is to be noted that since the two pistons 42 and 44 are identical and for concision purposes, only the piston 42 will be described in details herein.

The piston 42 includes at least one sealing ring 46 (only one shown) and is generally hollow so as to receive a bearing 48 so mounted therein via a pin 50 as to be rotatable therein. The outer surface 52 of the bearing 48 abuts an ellipsoid inner surface 54 of the guide 30.

The engine 20 also includes a return arrangement comprising two brackets 56 mounted to the piston 42; two telescoping pins 58 interconnecting the brackets 56 and a center portion of the cylinder 32; and two compression springs 60 biasing the piston 42 outwardly is provided so that the contact between the bearing 48 and the guide 30 is continuous, as will be described herein below.

Of course, other types of return arrangements could be provided. For example, the pistons could be provided with cam-following bearings and the guide 30 could be provided with a corresponding bearing receiving channel.

As can be better seen form FIG. 2, the portion of the shaft 34 that is adjacent to the cylinder 32 is hollow and in fluid connection with the inside of the cylinder 32. A primary combustion chamber 62 is thus defined inside the rotating shaft 34. The shaft also includes an aperture 64. As can be seen in this view, the axis of the shaft is collinear with the axis of the body 22. The primary combustion chamber is therefor centrally located in the body.

As will be further described herein below, the free space between the pistons 42 and 44 defines a secondary combustion chamber 72 where the gases will expand.

Figure 5:
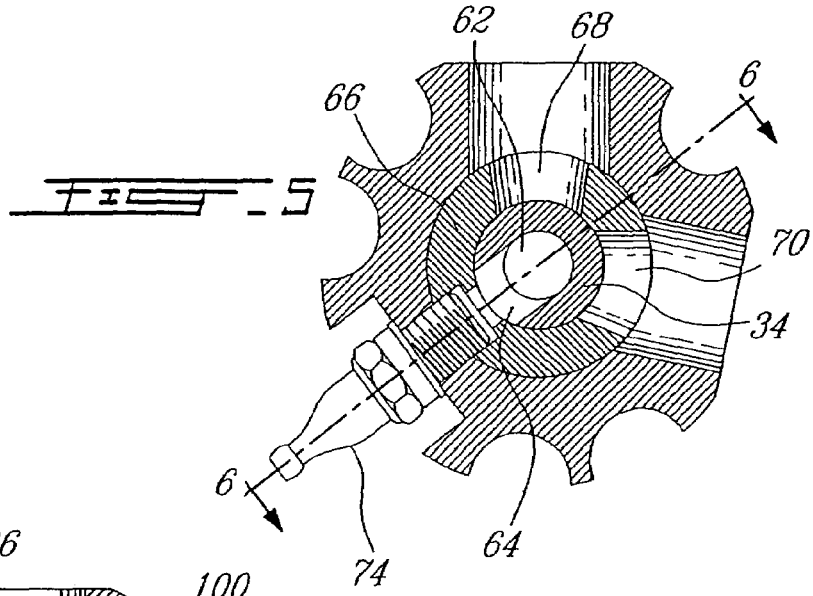
FIG. 5 is a sectional view illustrating the spark plug and the rotating valve of the internal combustion engine.
Figure 6:
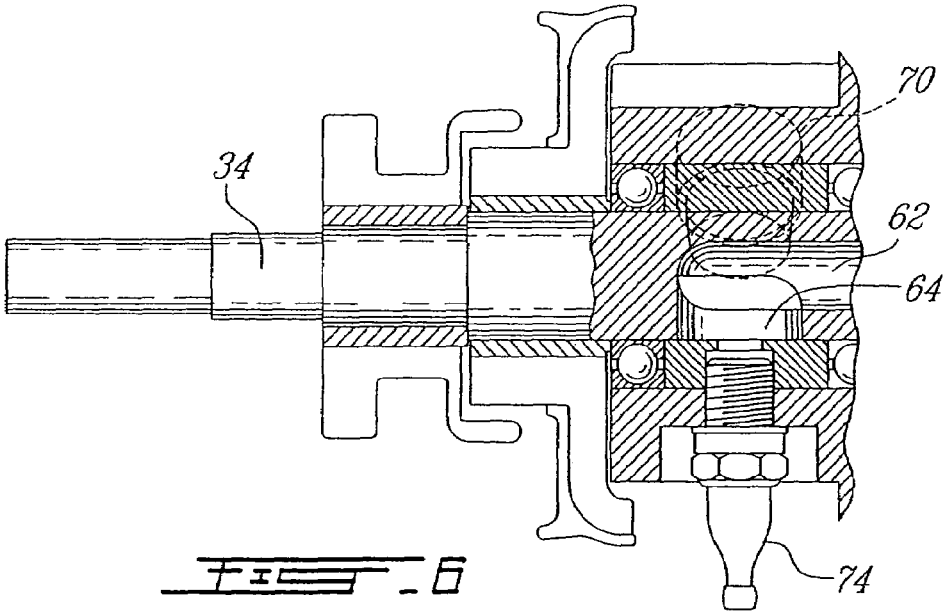
FIG. 6 is a sectional view taken along line 6—6 of FIG. 5.
Figure 7:
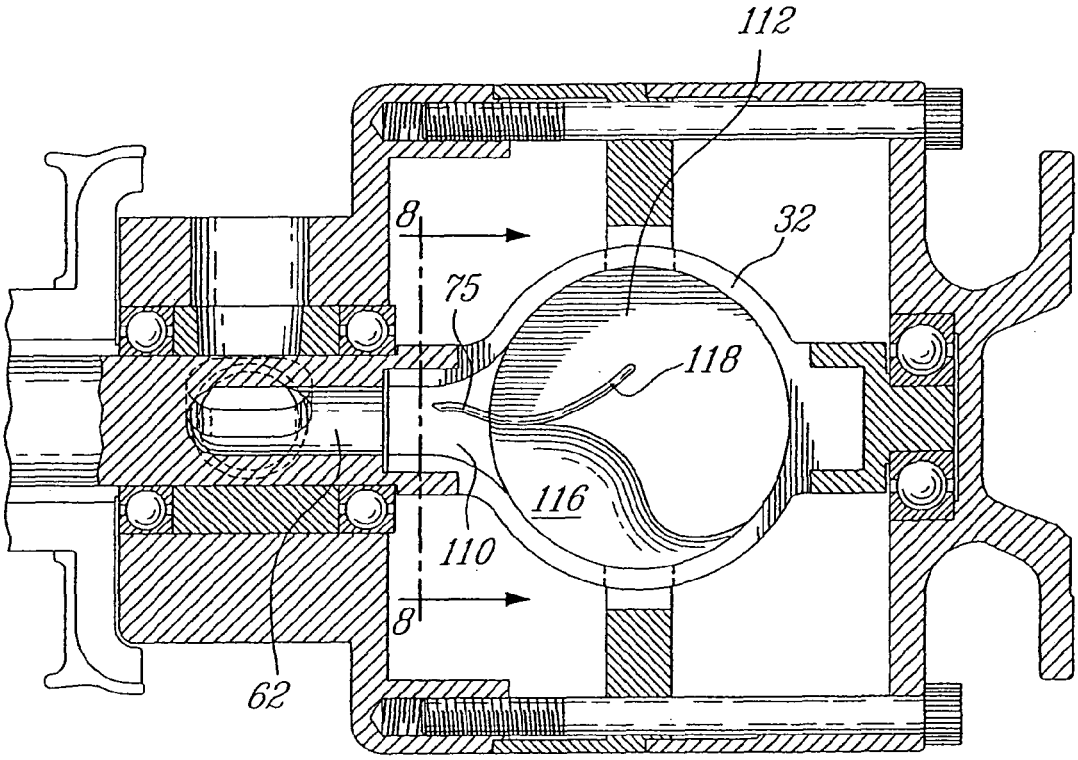

Turning briefly to FIGS. 5 and 6, a rotating valve will be described. The rotating valve is formed by a sleeve 66 having an intake aperture 68 and an exhaust aperture 70. The intake portion of the engine's cycle will therefore occur when the aperture 64 is in register with the intake aperture 68 and the exhaust portion of the engine's cycle will occur when the aperture 64 is in register with the exhaust aperture 70. The internal combustion engine 20 also includes a spark plug 74 that, once every turn of the shaft 34, comes into register with the aperture 64 to thereby ignite the gases present in the primary combustion chamber 62.

As will easily be understood by one skilled in the art, the inlet aperture 68 is to be connected to a fuel-air mixture delivery device such as, for example, a carburetor (not shown), and the outlet aperture 70 is to be connected to an exhaust system (not shown) for adequate operation of the internal combustion engine 20.

Figure 4:
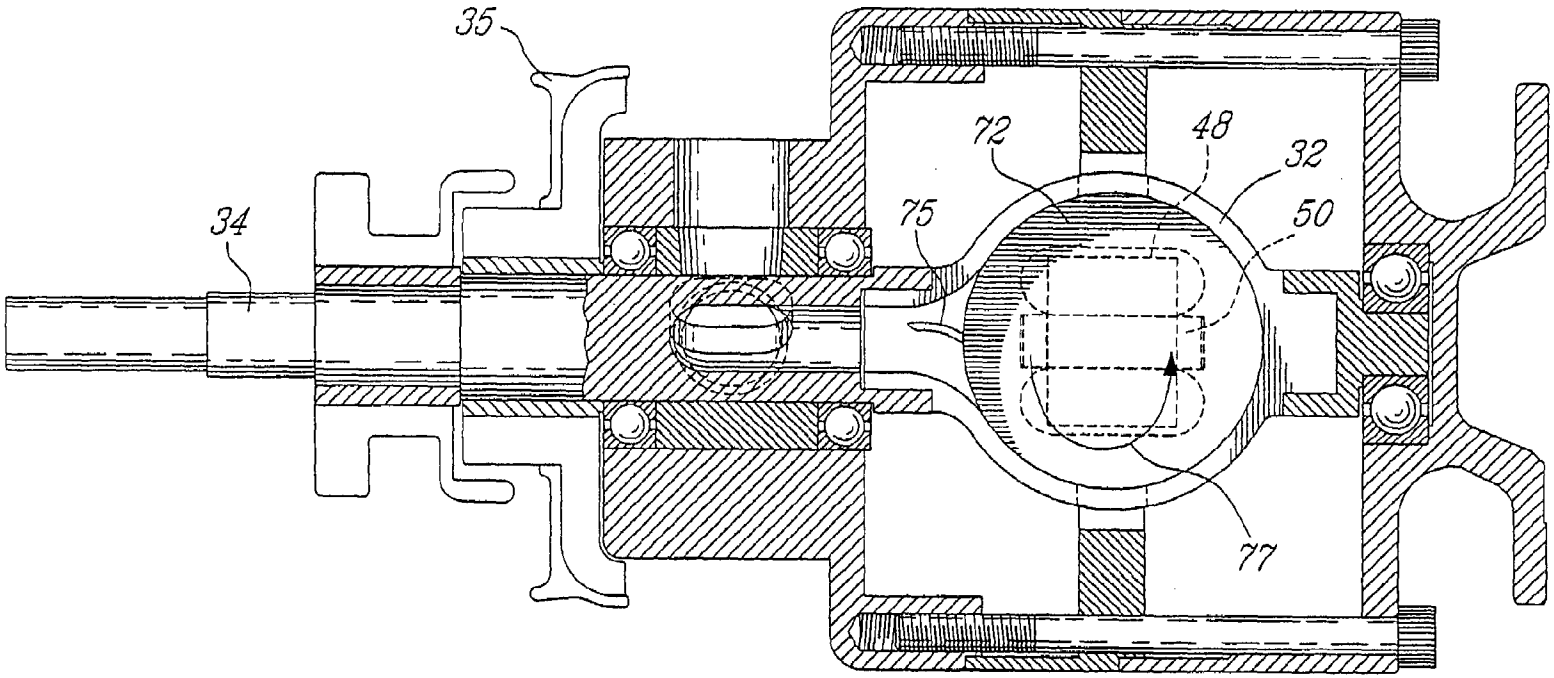
FIG. 4 is a sectional view taken along line 4-4 of FIG. 1I.

Turning to FIG. 4 of the appended drawings, the inlet of the cylinder 32 is provided with a curved baffle 75 forcing the gases entering the cylinder 32 to create a vortex therein (see arrow 77) to improve the combustion of these gases. Of course, as will be described herein below, the intake/outlet arrangement could be different from the ones shown in the appended drawings.

Figure 3:
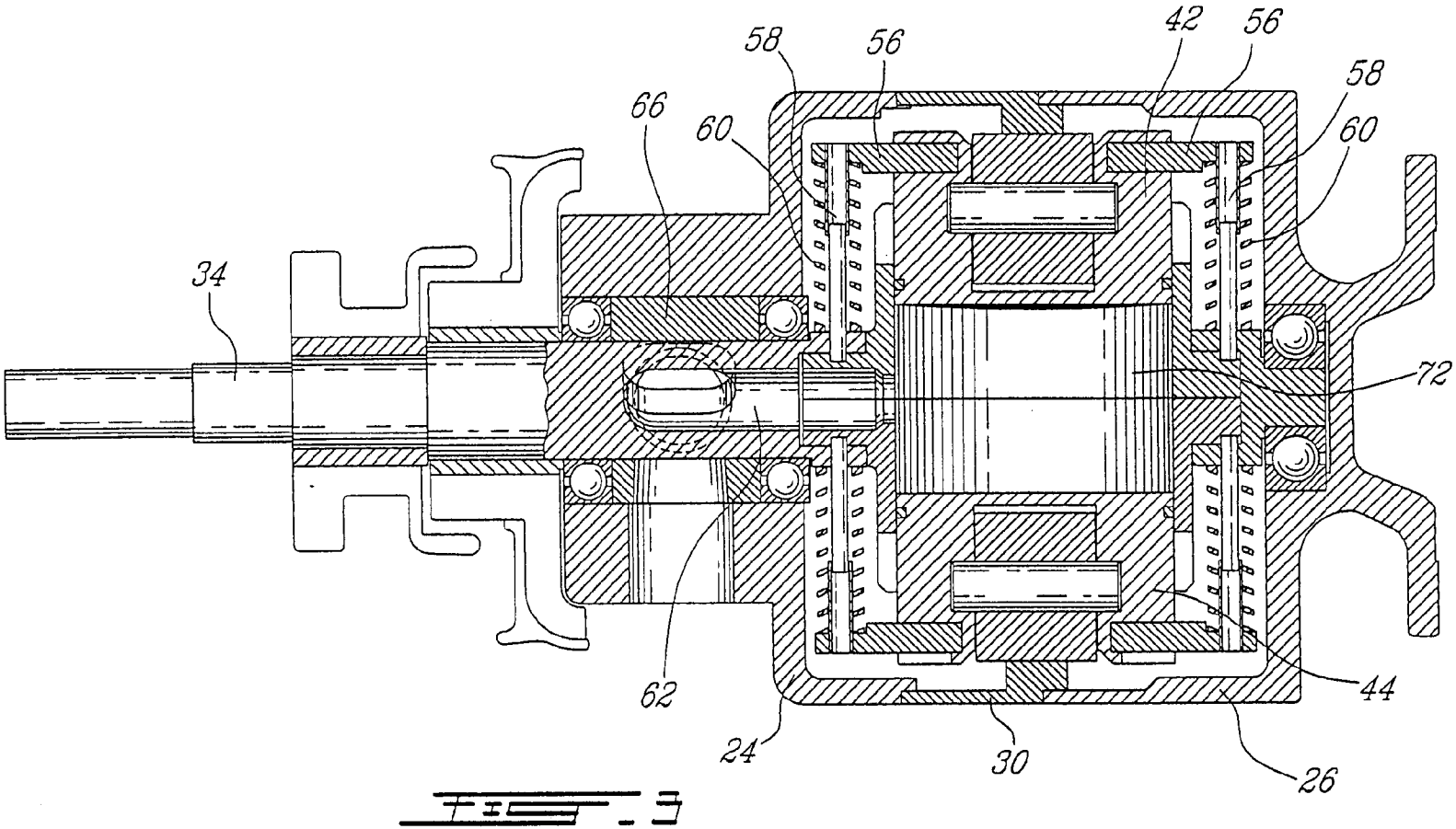
FIG. 3 is a sectional view taken along line 3—3 of FIG. 1I.

While FIG. 2 shows the internal combustion engine 20 with the pistons 42 and 44 in a position where they are close to one another, FIG. 3 shows the pistons in their most far apart position. This Figure illustrates the operation of the return arrangement. The springs 60 are in their uncompressed position and the telescoping pins 58 are fully extended.

One skilled in the art will easily understand that the telescoping pins 58 could easily be modified to yield a lubricant, coolant or fuel pump for the engine.

As will be understood by one skilled in the art, the return arrangement is advantageous upon starting the engine 20 should the engine 20 be stored for a prolonged period of time, ensuring that the pistons follow the ellipsoid guide.

It is to be noted that various mechanical elements have been simplified in the appended drawings for clarity purposes. One skilled in the art of mechanical engineering would be in a position to implement the concepts presented herein.

Turning now to FIGS. 1A to 1K, the operation of the four-cycle internal combustion engine 20 will be described. It is to be noted that many elements are not shown in these figures for clarity purpose. As can be seen from arrow 76, the rotation of the cylinder 32 is counterclockwise. Of course, the arrangement of the engine could easily be modified to yield a clockwise rotation.

FIG. 1A shows the internal combustion engine 20 in the position for the explosion. The pistons 42 and 44 are nearly at the so called "top-dead center" position, which, in the present case, means that the pistons are close to one another. The spark plug 74 is in register with the opening 64 to thereby ignite the compressed gas present in the primary combustion chamber 62.

FIG. 1B shows the internal combustion engine 20 where the pistons 42 and 44 are passed the top-dead center, and are therefore moving away from each other (see arrows 78 and 80) under the pressure from the expanding gases in the secondary combustion chamber 72. The expansion portion of the engine's cycle begins.

In FIG. 1C, the pistons 42 and 44 are near their bottom-dead center and are still moving away from one another (see arrows 78 and 80). The aperture 64 of the shaft 34 begins to face the exhaust aperture 70 and the exhaust portion of the engine's cycle begins. The pistons are still moving away from one another from the inertia gathered.

FIG. 1D shows the pistons 42 and 44 beginning to move towards one another (see arrows 82 and 84). The aperture 64 is facing the exhaust aperture 70. Combustion gases are therefore exhausted (see arrow 86).

FIG. 1E show the internal combustion engine 20 near the end of the exhaust portion of the cycle, the pistons 42 and 44 approaching the second top-dead center.

Turning now to FIG. 1F, the pistons 42 are exactly at their second top-dead center. This is therefore the end of the exhaust portion of the engine's cycle and the beginning of the intake portion of the cycle.

Figure 1G:
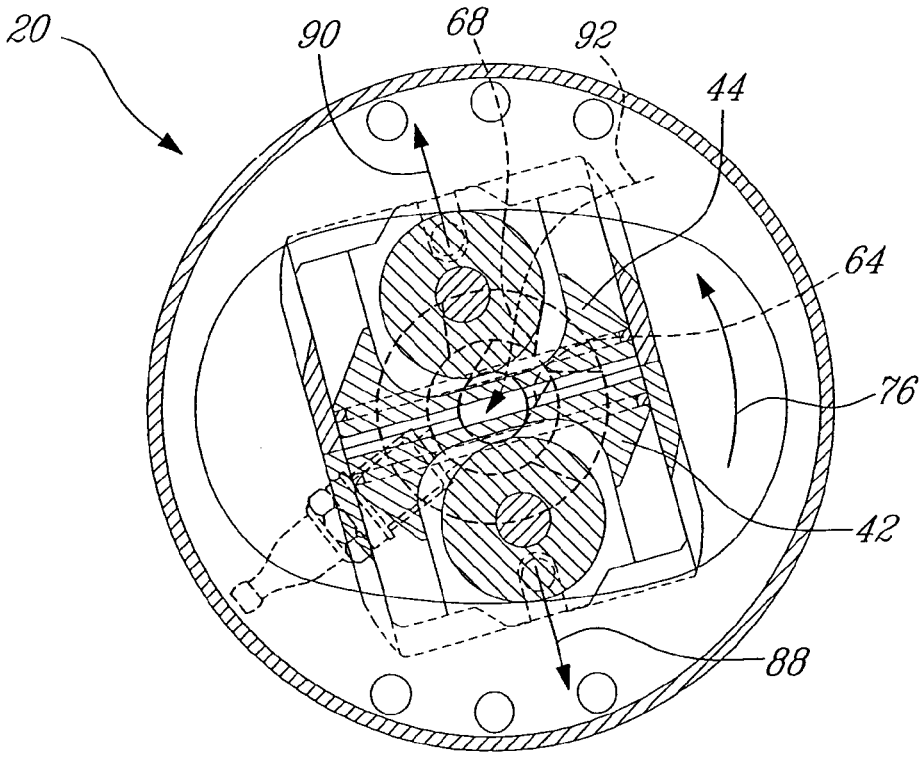

FIG. 1G illustrates the actual beginning of the intake portion of the engine's cycle. The pistons 42 and 44 are moving away from one another (see arrows 88 and 90) thereby drawing gases from the intake aperture 68 of the rotary valve (see arrow 92) since the aperture 64 is aligned with the intake aperture 68.

Figure 1H:
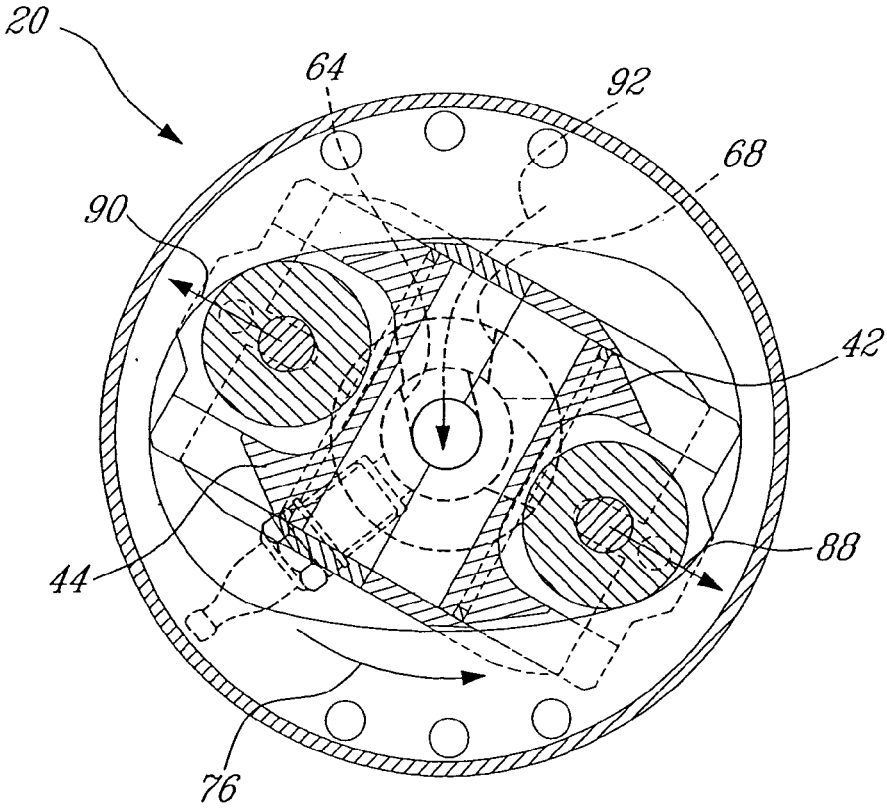

The intake portion of the engine's cycle continues in FIG. 1H.

Figure 1I:
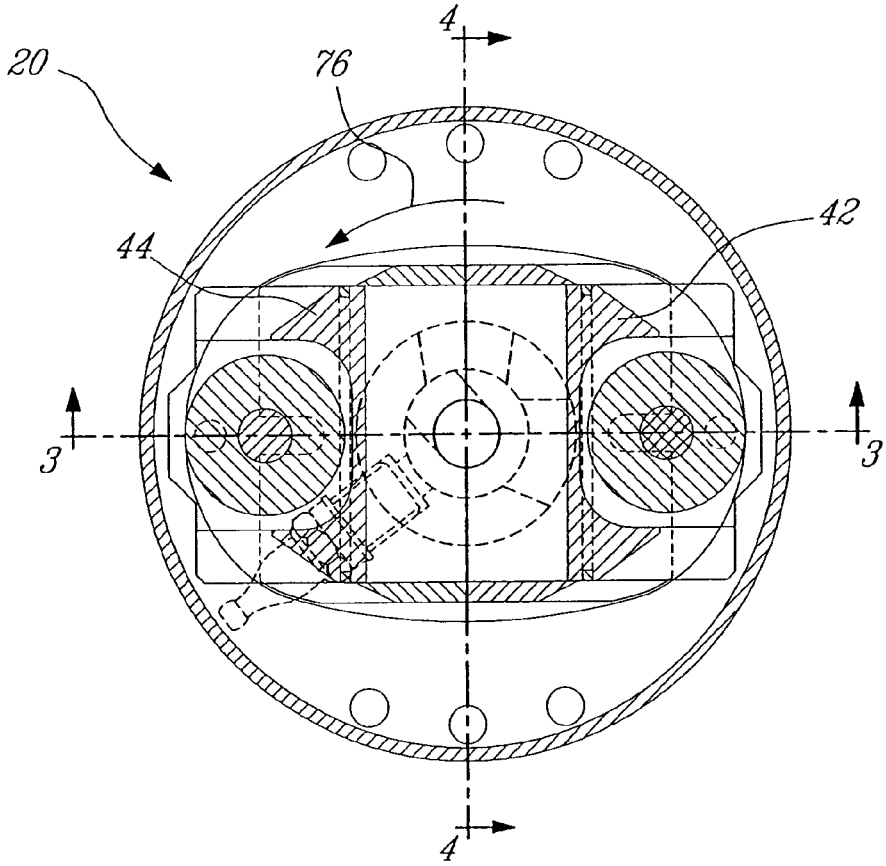

FIG. 1I shows the internal combustion engine 20 with the pistons 42 and 44 in their second bottom-dead center. The intake portion of the engine cycle is ended and the compression portion has not yet begun.

Figure 1J:
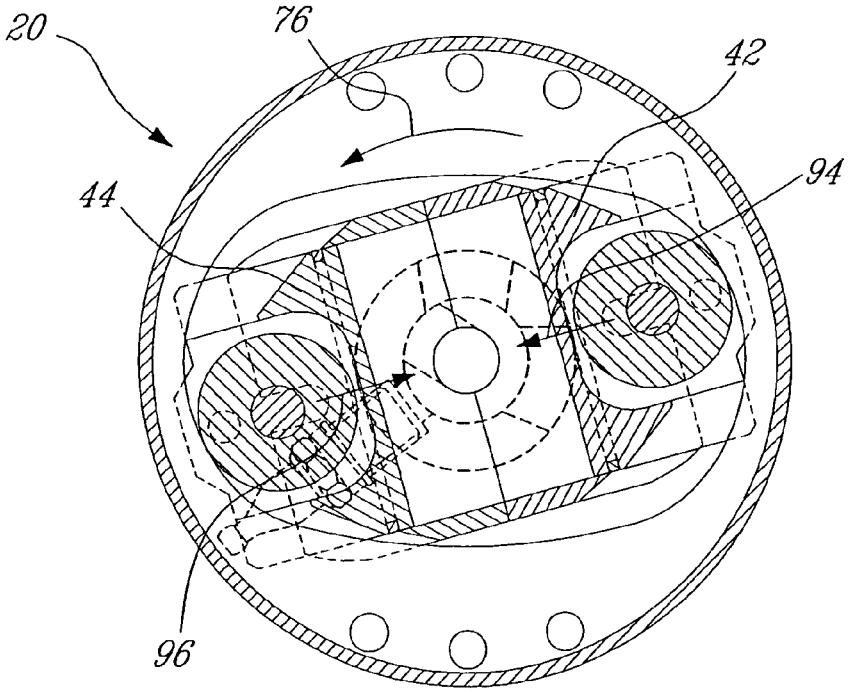

FIG. 1J illustrates the beginning of the compression portion of the engine's cycle. The pistons 42 and 44 begin to move towards each other (see arrows 94 and 96).

Figure 1K:
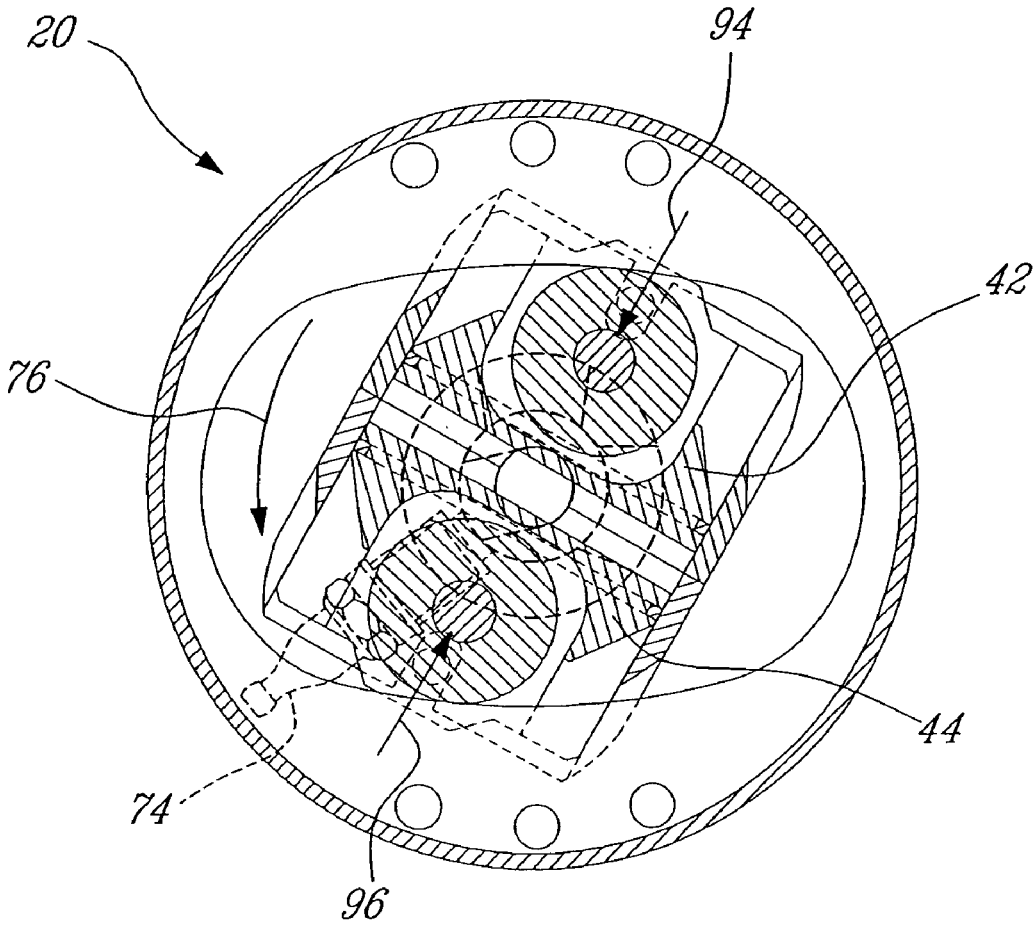

Finally, FIG. 1K illustrates the end of the compression portion of the engine's cycle. The pistons 42 and 44 are still moving towards one another and the aperture 64 is in contact with the spark plug 74.

The cycle then returns to FIG. 1A for the next explosion.

As will easily be understood by one skilled in the art, an interesting feature of the present invention is that the four cycles of the internal combustion engine 20 are completed in a single revolution of the shaft 34 instead of requiring two as in conventional engines.

Figure 5A:
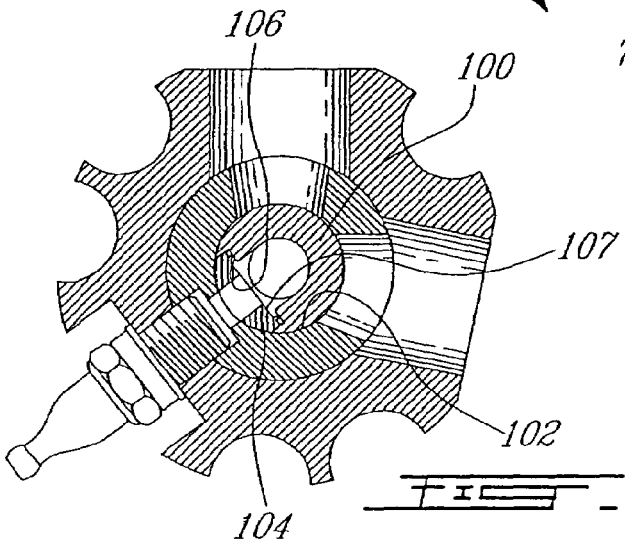
FIG. 5A is a sectional view similar to FIG. 5 but showing an alternative rotating valve.

Turning now to FIG. 5A of the appended drawing an alternate rotary valve according to another aspect of the present invention will be described.

The rotary valve illustrated in FIG. 5A is interesting when a larger clearance between the shaft 100 and the sleeve 102 is required to reduce the friction between these two elements and to prevent seizing. In FIG. 5A, the outside diameter of the shaft 100 is smaller than the internal diameter of the sleeve 102 to reduce friction. To ensure a good sealed joint between the shaft 100 and the sleeve 102, an insert 104 is mounted in a shouldered channel 106 of the shaft 100. The external diameter of the insert 104 is similar to the internal diameter of the sleeve 102 to thereby ensure a good seal without unduly increasing friction since only a portion of the diameter and of the length of the shaft 100, i.e. the insert containing portion, is in continuous contact with the sleeve 102. A tensioning system, for example an O-ring, is interposed between the shouldered channel and the insert 104 to ensure a good contact between the insert 104 and the sleeve 102. Furthermore, the insert 104 includes a relatively large shoulder 107 against which the expanding combustion gases apply a force to improve the seal between the insert 104 and the sleeve 102.

Figure 7:
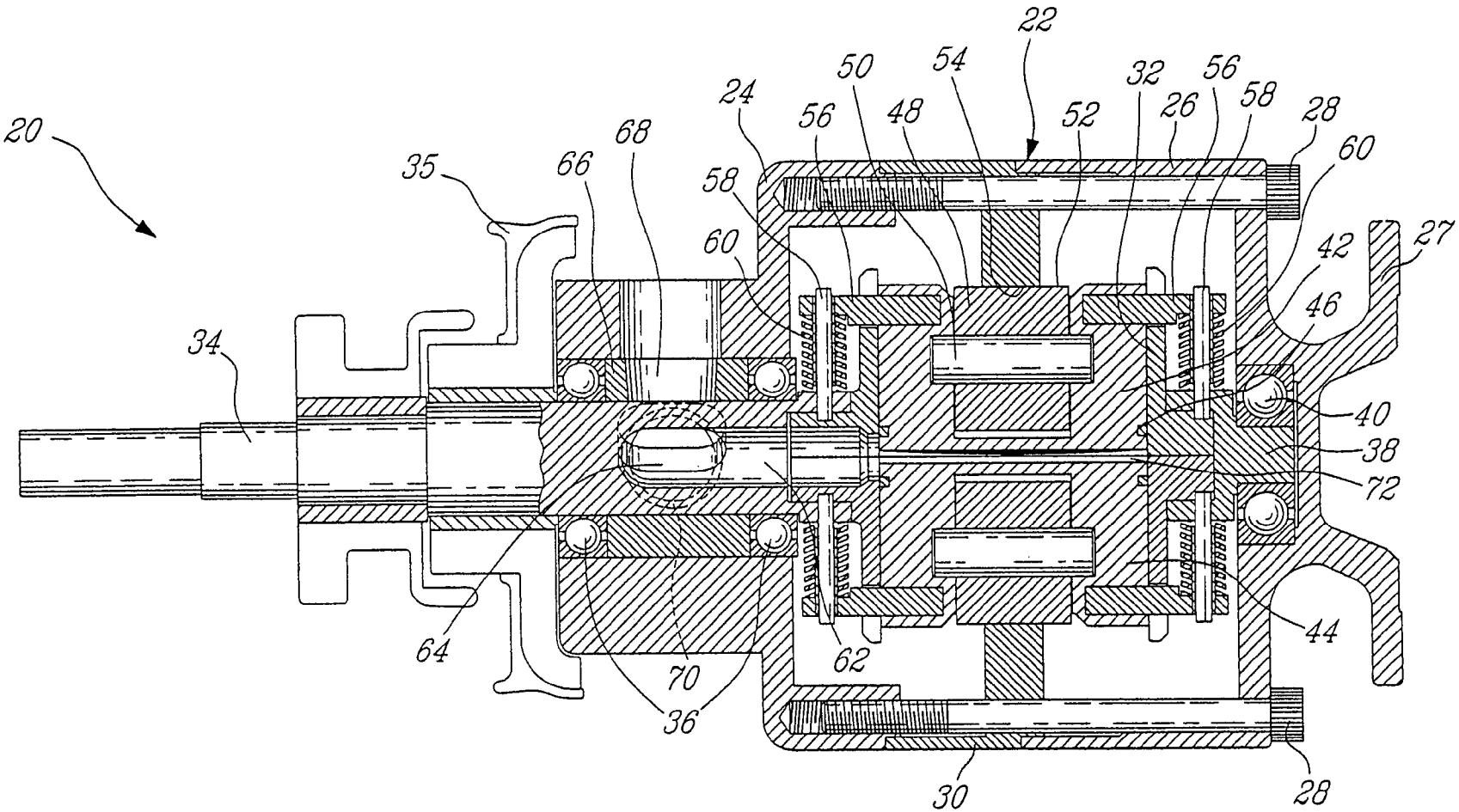
FIG. 7 is a sectional view similar to FIG. 4 and illustrating an alternative piston mounted in the cylinder.
Figure 8:
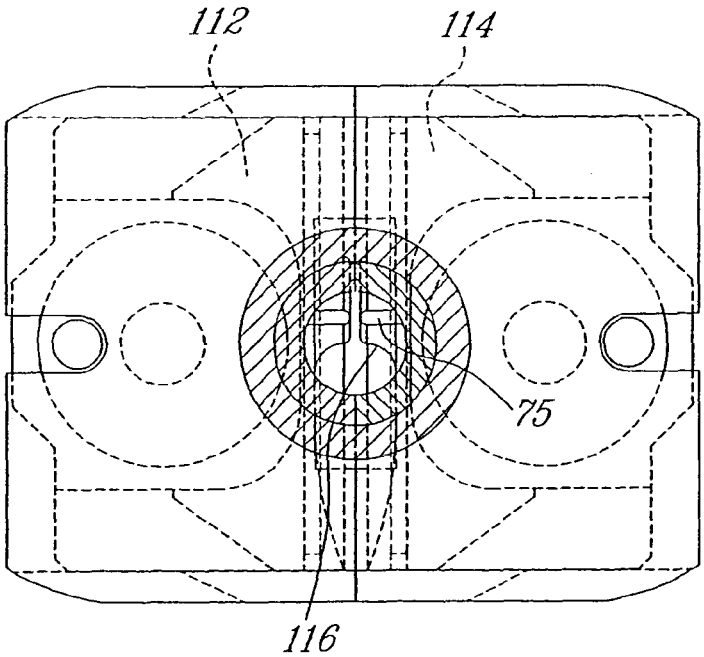
FIG. 8 is a sectional view taken along line 8—8 of FIG. 7.

Turning to FIGS. 7 and 8 of the appended drawings, an alternate configuration of pistons will be described. This alternate arrangement aims at preventing gases from the primary combustion chamber from hitting the pistons sideways and thus deteriorate them prematurely.

As will easily be understood by one skilled in the art, the majority of the gases entering from the primary combustion chamber 62 into the cylinder will go through the right portion 110 of the baffle 75. The face of the pistons 112 and 114 is therefore designed so that the gases may enter without hitting the sides thereof.

FIG. 8 illustrates the shape of the pistons 112 and 114 that include a depression 116 that is such that the gases entering the cylinder 32 will create a vortex and will gradually enter the flat interspace between the pistons. The depression is formed in the piston face along an edge of the piston face, proximate the intake port 110.

The faces of the pistons 112 and 114 also include a baffle 118 to guide the exhaust gases towards the exhaust outlet.

Figure 9:
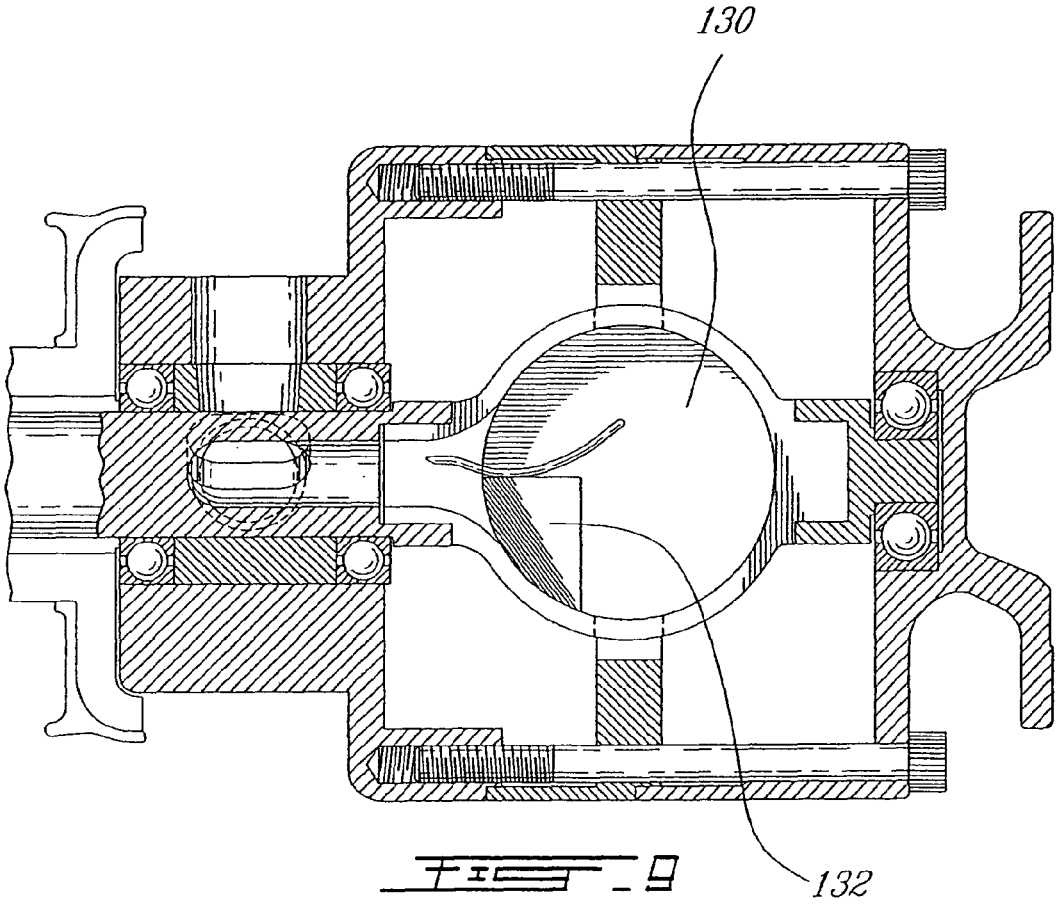
FIG. 9 is a sectional view similar to FIGS. 4 and 7 and illustrating an alternative piston mounted in the cylinder.

FIG. 9 of the appended drawings illustrates another alternate configuration of pistons will be described. Again, this alternate arrangement aims at preventing gases from the primary combustion chamber from hitting the pistons sideways and thus deteriorate them prematurely.

Instead of having a relatively complex depression as discussed herein above with respect to FIGS. 7 and 8, the alternate of FIG. 9 shows a piston 130 provided with a flat ramp 132 having the same function as the depression 116 of FIGS. 7 and 8. The depression and ramp both comprise means for creating a vortex.

It will easily be understood by one skilled in the art, that while the above description of the combustion engine 20 is such that the body of the engine is fixed and that the cylinder and shaft rotate, it would be within the scope of the present invention to have an engine where the shaft and cylinder are fixed and the ellipsoid guide rotates.

Figure 10:
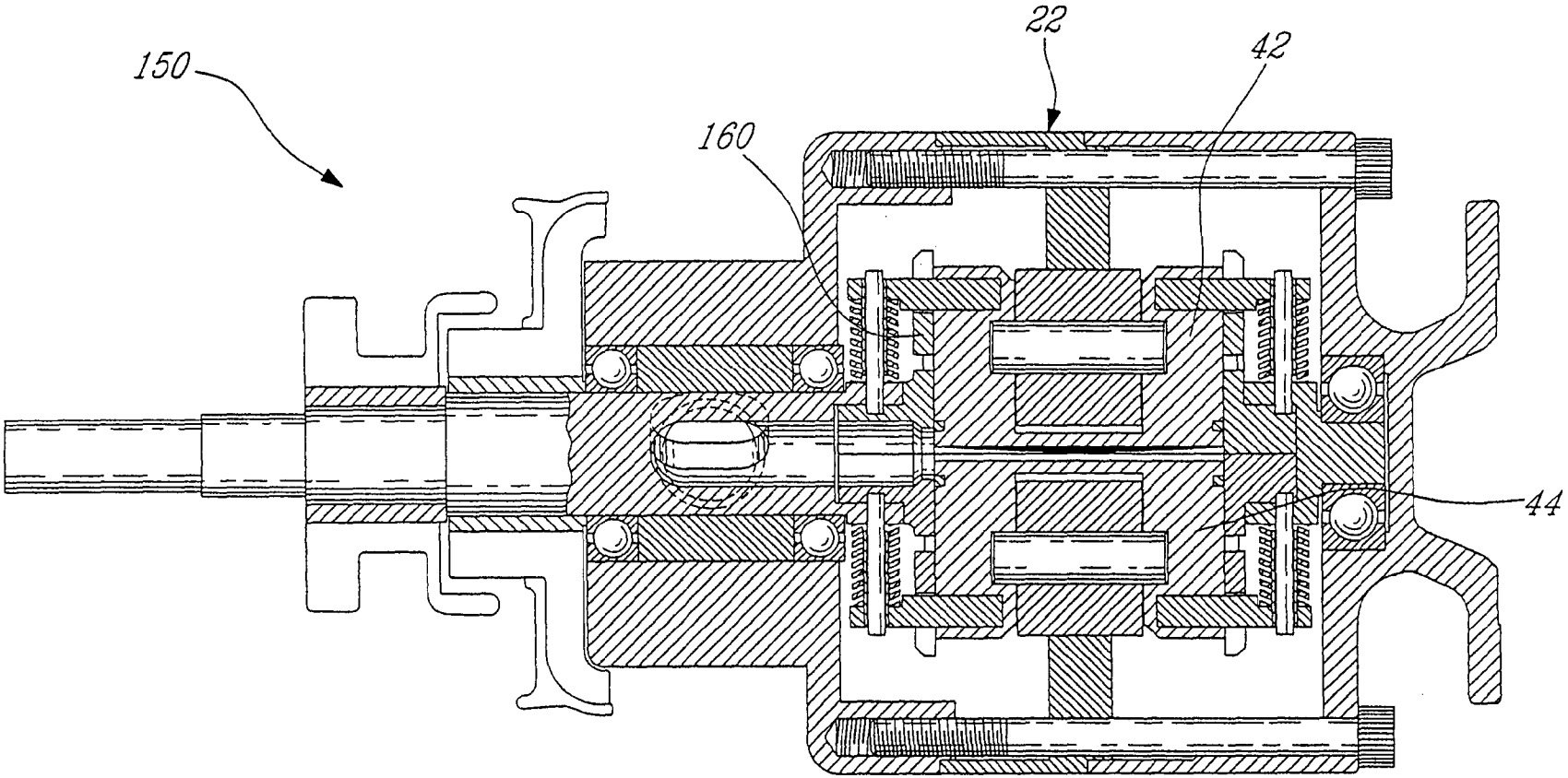
FIG. 10 is a sectional view illustrating a two-cycle internal combustion engine according to another embodiment of the present invention, the engine being shown at the end of the compression cycle, prior to combustion.
Figure 11:
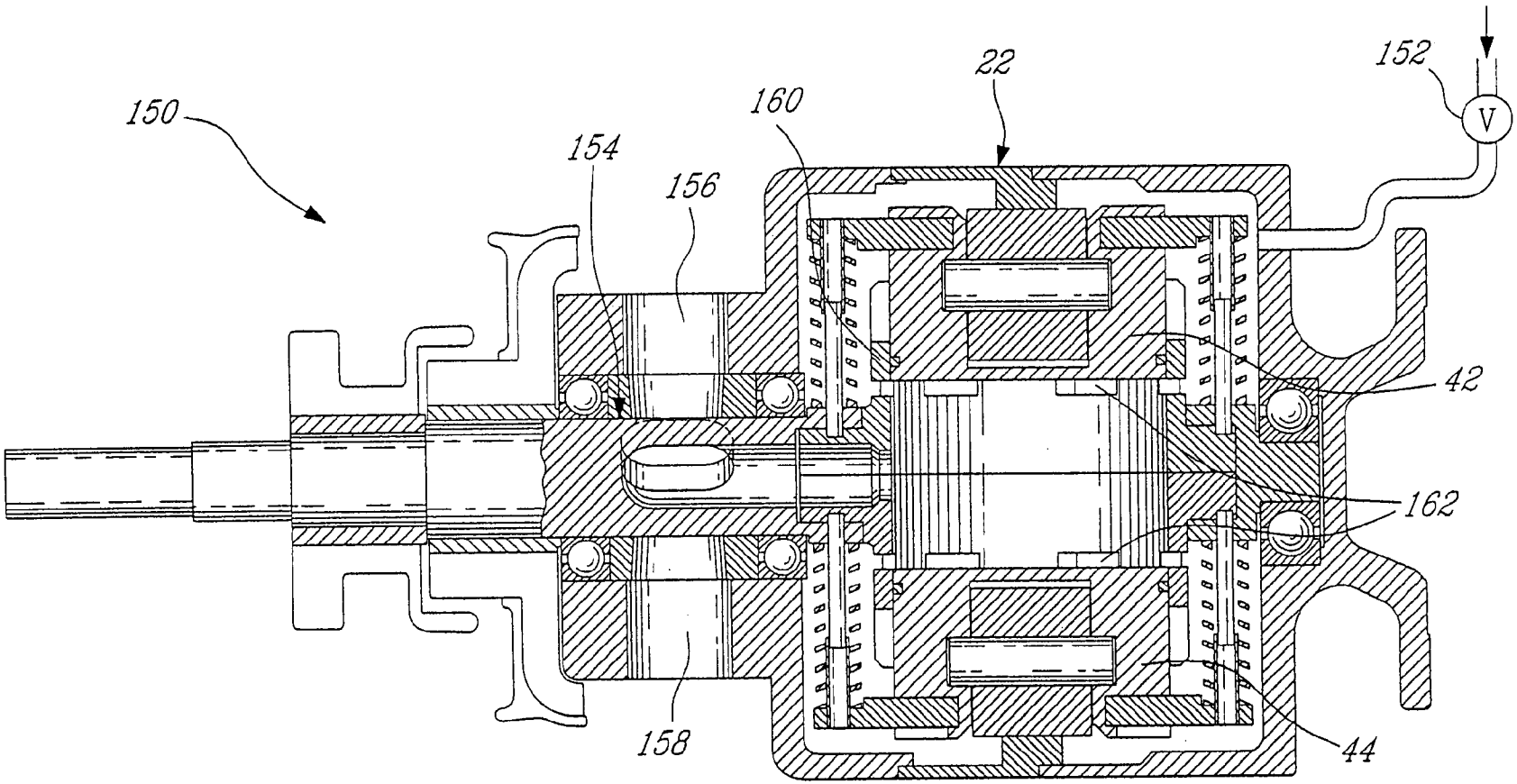
FIG. 11 is a sectional view illustrating the engine of FIG. 10 at the beginning of the intake of the fuel-air mixture in the cylinder.

Turning now to FIGS. 10 and 11 of the appended drawings, a two-cycle internal combustion engine 150 according to an aspect of the present invention will be described. It is to be noted that since the engine 150 is very similar to the engine 20 described herein above, only the differences between these engines will be described herein below.

The engine 150 includes an inlet valve 152 allowing a fuel-air mixture to enter the body 22. A rotary valve 154 provided with two outlets 156 and 158 is designed to exhaust the combustion gases.

The cylinder 160 is provided with circumferential apertures 162 connecting the inside of the cylinder 160 and the inside of the body 22 when the pistons 42 and 44 are at or near their bottom dead position as illustrated in FIG. 11.

Since the operation of a two-cycle internal combustion engine is believed well known to those skilled in the art, it will only be briefly described herein.

FIG. 10 illustrates the engine 150 in a state where the fuel-air mixture present in the cylinder 160 is compressed and ready to be ignited. The pistons are in their top dead position. During the passage of the pistons from their bottom dead position to their top dead position, the valve 152 was open to allow the air-fuel mixture for the next explosion to enter the body 22.

The explosion of the gases will force the pistons 42 and 44 away from one another to compress the gases present in the body 22. The exhaust valve 154 allows the combustion gases to egress the engine 150.

FIG. 11 shows the pistons in their bottom dead position. The apertures 162 allow the air-fuel mixture present in a semi-compressed state inside the body 22 to enter the cylinder 160. Once the pistons begin their movement towards their top dead position to compress the mixture, the openings 162 will be closed by the presence of the pistons.

Figure 12A:
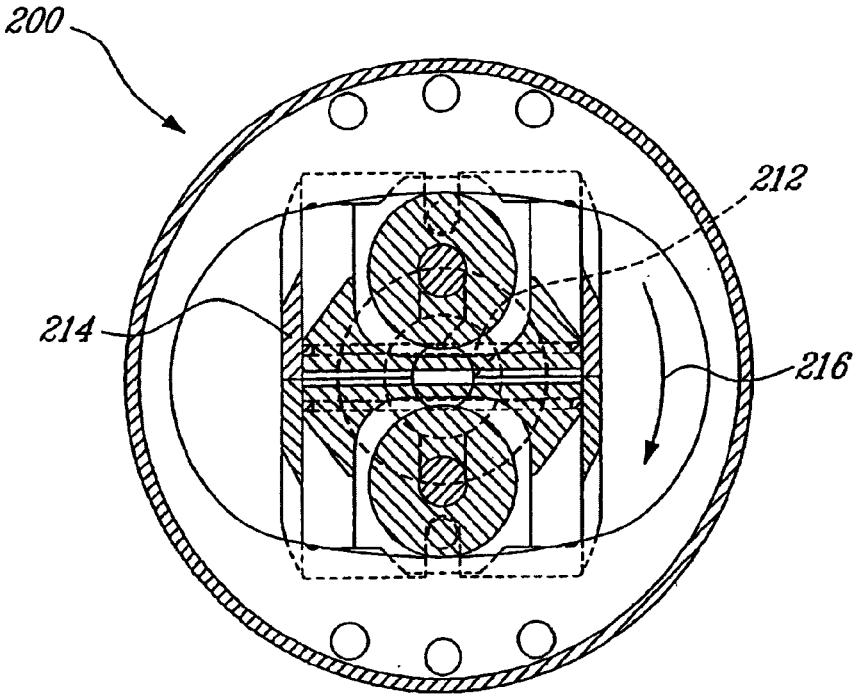
FIGS. 12A to 12D are sectional views of a fluid pump according to another aspect of the present invention; these figures illustrate the operation of the pump.
Figure 12B:
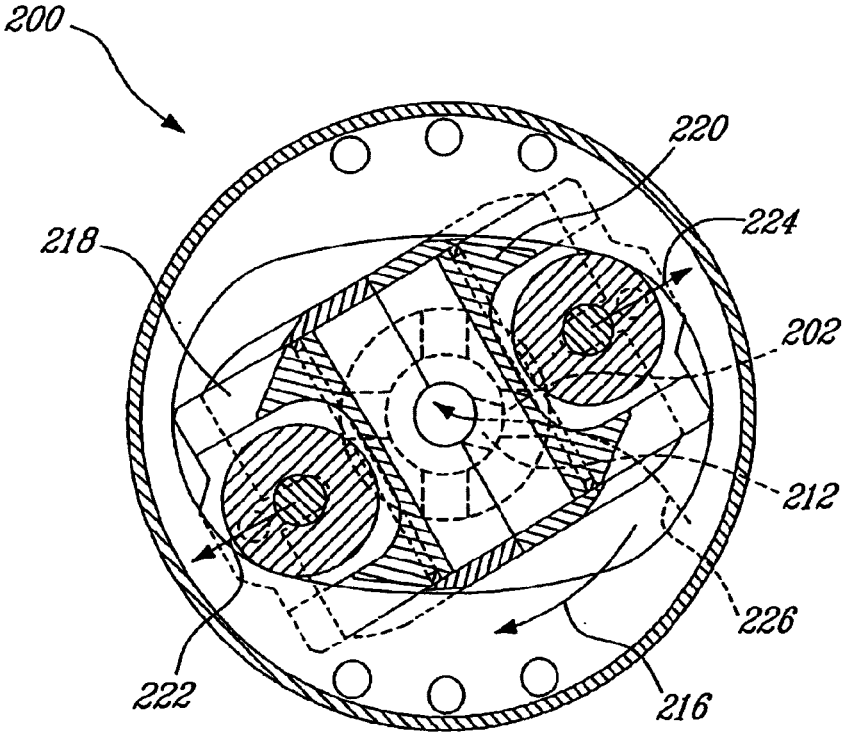
Figure 12C:
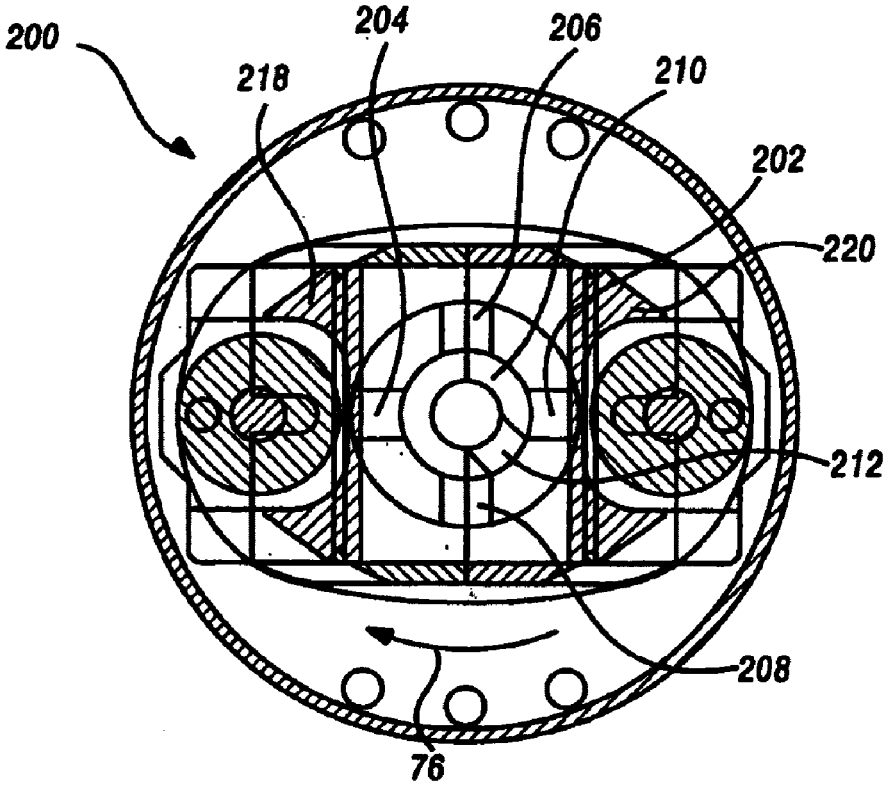
Figure 12D:
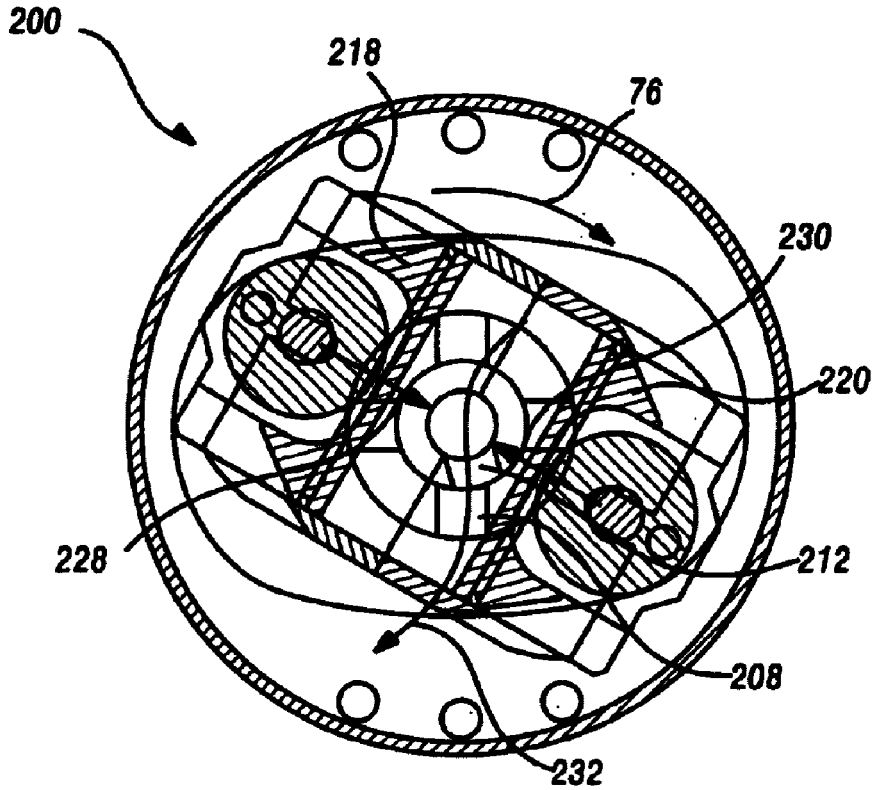
Figure 13:
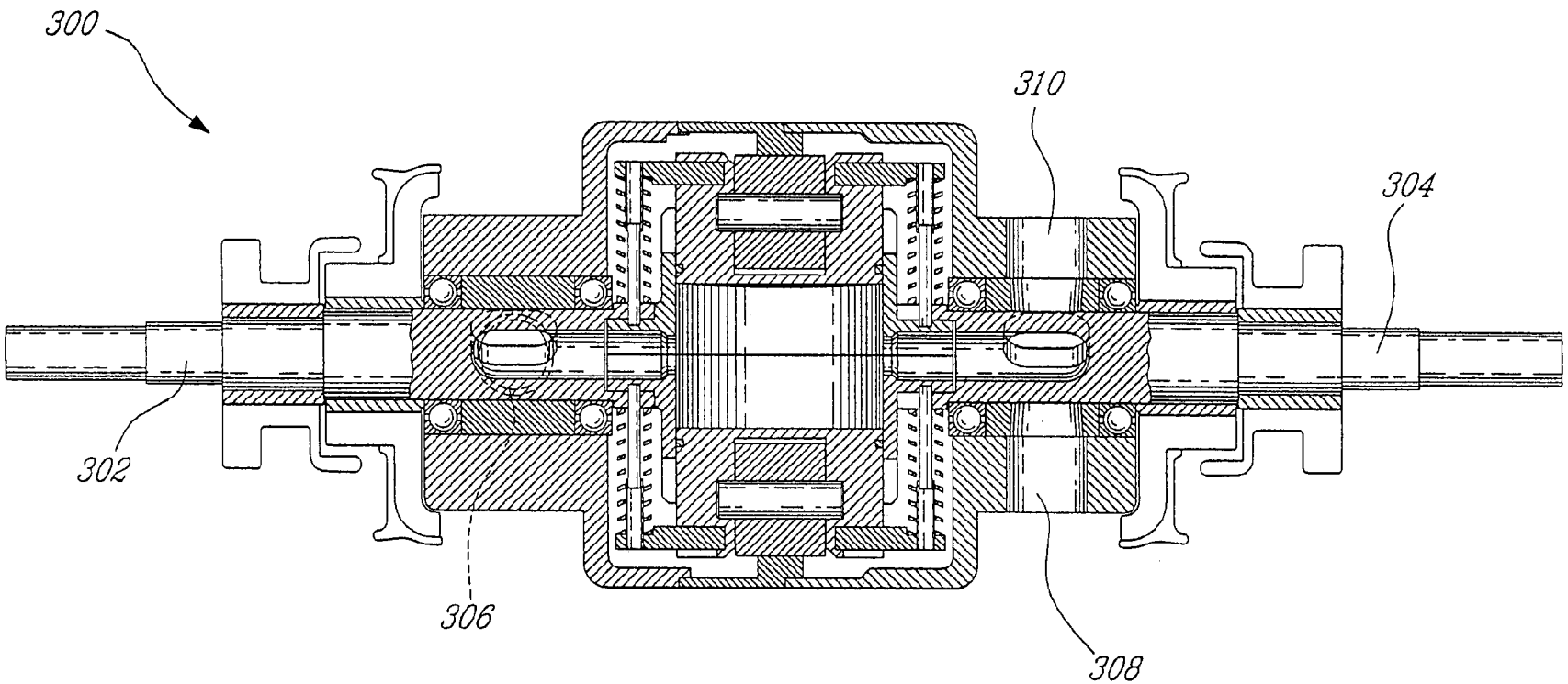
FIG. 13 is a sectional view of a fluid pump having inlets and outlets providing on opposite sides thereof.

Referring now to FIGS. 12A to 13, another aspect of the present invention, concerned with fluid pumps will be described. It is to be noted that this configuration could also be used as an hydraulic motor.

Turning to FIGS. 12A to 12D, the first of two pumping cycles of a pump 200 will now be described.

It is to be noted that since the elements of the pump 200 are very similar to the elements of the combustion engine, they will not be described in detail herein below.

As can be better seen from FIG. 12C, the pump 200 includes two opposite fluid inlets 202 and 204 and two opposite fluid outlets 206 and 208. The shaft 210 includes an opening 212 that is brought in register with the inlets and outlets as will be described herein below via the rotation of the shaft.

In FIG. 12A, the pump is at a dead spot, i.e., that the opening 212 is not in register with any inlet or outlet. Rotation of the cylinder 214 begins (see arrow 216).

FIG. 12B illustrates the pistons 218 and 220 moving away from one another (see arrows 222 and 224). This movement of the pistons cause fluid to enter the space between the pistons through the inlet 202 since the opening 212 is in fluid connection with the inlet 202 (see arrow 226).

FIG. 12C illustrates the pump at a second dead spot when the opening 212 is between the inlet 202 and the outlet 208 and the pistons 218 and 220 are at their bottom dead center.

Finally, FIG. 12D illustrates the two pistons 218 and 220 moving towards each other (see arrows 228 and 230). The opening 212 faces the outlet 208 to therefore force fluid to egress via the outlet 208 (see arrow 232).

For concision purposes, the second pumping cycle, i.e., the entry via the inlet 204 and the egress via the outlet 206 will not be described in details herein since they are identical to the above-described first pumping cycle.

It is to be repeated that the pump 200 has two pumping cycles for every revolution. Accordingly, two such pumps, mounted to the same shaft (not shown) and at an angle of 90 degrees would generate a continuous pumping action.

Turning finally to FIG. 13 of the appended drawings, a pump 300 will briefly be described.

The pump 300 has the same method of operation as the pump 200 described herein above.

A main difference between the pump 300 and the pump 200 is that the pump 300 has two opposite and collinear shafts 302 and 304. It is thus possible to locate the two fluid inlets 306 (only one shown) on the shaft 302 and the two fluid outlets 308 and 310 on the shaft 304.

It is to be noted that this "two opposite and collinear" shaft strategy could also be used in a combustion engine as described in FIGS. 1A to 11.

Figure 14A:
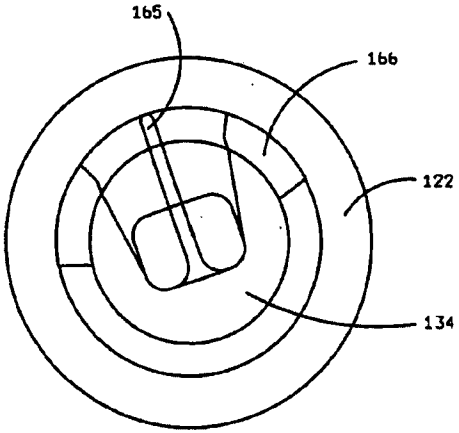
FIGS. 14*a* and 14*b* are cross sectional views during intake with a second embodiment of the valve.
Figure 14B:
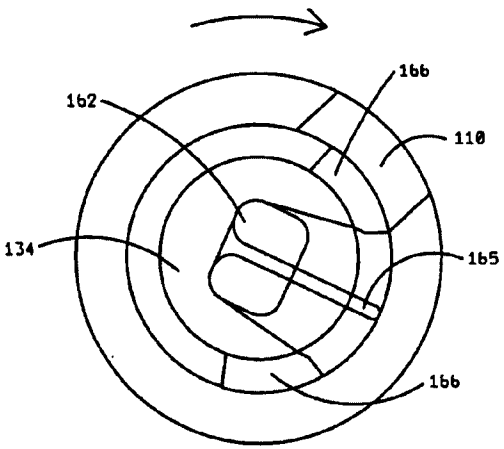

Referring to FIGS. 14A and l4B, an alternative embodiment of the valve leading to the combustion chamber is depicted. The shaft 134 is located within body 122 with sleeves 166 interposed between them. Combustion chamber 162 has a left edge, right edge and bottom. A bridge 165 extends upwardly from the bottom of the combustion chamber and extends to the inner surface of the body 122. In FIG. 14A, the right side of the combustion chamber is aligned with the left side of intake port 110. As the shaft 134 and sleeve 166 continue in a clockwise motion, the combustion chamber becomes open to the intake port 110 allowing the influx of a fuel/air mixture. The intake cycle ends when the left side of the combustion chamber becomes aligned with the right side of the intake port 110. This is shown in FIG. 14B. The shaft and sleeve continue in a clockwise motion and combustion occurs when the combustion chamber becomes open to a spark plug (not shown). The area surrounding the shaft 134 not covered by the sleeve 166 can be a separate piece or can be formed integrally with the shaft 134.

Figure 15A:
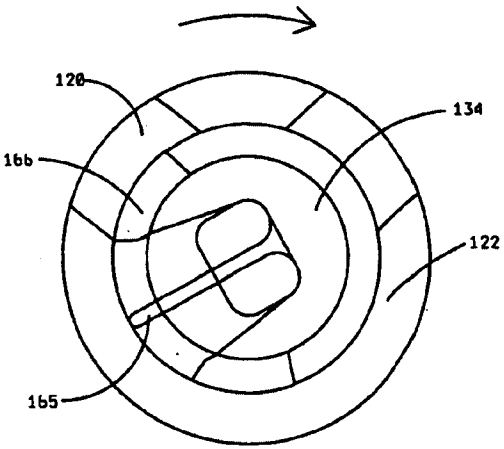
FIGS. 15*a* and 15*b* are cross sectional views during exhaust with a second embodiment of the valve.
Figure 15B:
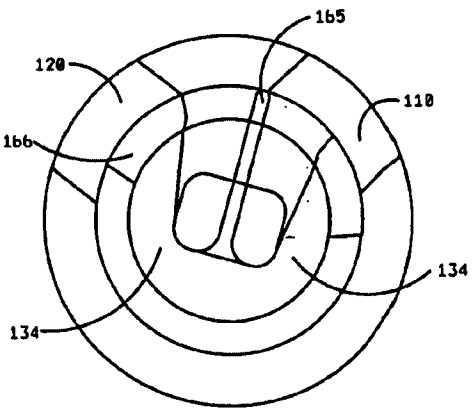

FIGS. 15A and 15B show the exhaust of the combustion chamber 162. FIG. 15A depicts the right side of the combustion chamber being aligned with the left side of the exhaust port 120. Continued clockwise motion of the shaft and sleeve causes the combustion chamber to become open to the exhaust port 120. The exhaust cycle is completed when the left side of the combustion chamber becomes aligned with the right side of the exhaust portion 120 as is depicted in FIG. 15B.

Figure 16:
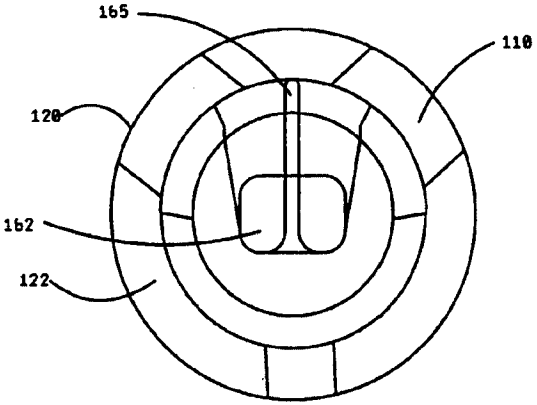
FIG. 16 is a cross sectional view of the second embodiment of the valve between intake and exhaust.
Figure 17:
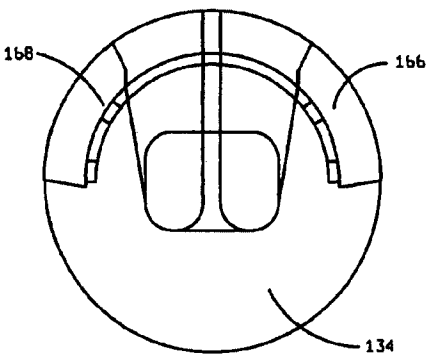
FIG. 17 is a cross section of the shaft and sleeve.

FIG. 16 depicts the midway point between the exhaust and intake. It is seen here that the bridge 165, extending from the bottom of the combustion chamber to the inner surface of the body 122 prevents intake entering port 110 to leave directly through exhaust port 120. The result is a cleaner burning, more efficient engine. As explained above, a tensioning system such as an O-ring 168, is used between the shaft 134 and sleeve 166.

Although the present invention has been described herein above by way of preferred embodiments thereof, it can be modified, without departing from the spirit and nature of the subject invention.

What is claimed is:

1. An internal combustion engine comprising:
a body;
a shaft rotatably mounted within said body;
a pair of pistons within said body, said pair of pistons attached to and extending from said shaft;
an intake port to allow fuel into said combustion chamber
each piston having a piston face, each piston face having an edge, and
at least one piston face having a means for creating a vortex, said means for creating a vortex formed along the edge of the piston face near said intake port.

2. The internal combustion engine of claim 1, wherein said means for creating a vortex is a depression.

3. The internal combustion engine of claim 1, wherein said means for creating a vortex is a ramp.

4. An internal combustion engine comprising:
a body;
a shaft rotatably mounted within said body;
a cylinder attached to said shaft
a pair of pistons within said cylinder;
an intake port in said cylinder,
each piston having a piston face, each piston face having an edge, and
at least one piston face having a depression to create a vortex, said depression formed along the edge of the piston face near said intake port.

5. The internal combustion engine of claim 4, wherein
said body has a centerline; and
said shaft extending along said body centerline.

6. The internal combustion engine of claim 4, further comprising:
a combustion chamber formed in said shaft; and
a secondary combustion chamber formed between said pistons.

7. The internal combustion engine of claim 4, further comprising:
an ellipsoid guide in said body; and
said pair of pistons retained in said ellipsoid guide.

8. The internal combustion engine of claim 4, further comprising:
a baffle on the piston face to direct exhaust gases to an exhaust outlet.

9. An internal combustion engine comprising:
a body, said body having an inner surface and an outer surface;
a shaft rotatably mounted in said body;
an intake port and an exhaust port formed in said body;
a combustion chamber formed in said shaft, said combustion chamber having a bottom wall, a left edge and a right edge; and
a bridge extending upwardly from said combustion bottom wall toward said body inner surface.

10. The internal combustion engine of claim 9, further comprising:
a sleeve positioned between said shaft and said body.

11. The internal combustion engine of claim 10 further comprising:
an O-ring between said sleeve and said shaft.

12. An internal combustion engine comprising:
a body having an axis;
a shaft rotatably mounted within said body;
a pair of pistons within said body,
a cylinder;
said pair of pistons reciprocating within said cylinder;
at least one pin extending from said shaft;
a bracket extending radially outwardly from one of said pistons and engaging said pin, and
a compression spring surrounding said at least one pin and bearing against said bracket.

13. The internal combustion engine of claim 12, wherein
said body has a centerline; and
said shaft extending along said body centerline.

14. The internal combustion engine of claim 12, further comprising:
a secondary combustion chamber formed between said pistons.

15. The internal combustion engine of claim 12, further comprising:
an ellipsoid guide in said body; and
said pair of pistons retained in said ellipsoid guide.

* * * * *